US010335622B2

(12) United States Patent
Hyslop

(10) Patent No.: US 10,335,622 B2
(45) Date of Patent: Jul. 2, 2019

(54) SPRINKLER HEAD WITH SMA SPRING

(71) Applicant: William J. Hyslop, Indianapolis, IN (US)

(72) Inventor: William J. Hyslop, Indianapolis, IN (US)

( * ) Notice: Subject to any disclaimer, the term of this patent is extended or adjusted under 35 U.S.C. 154(b) by 0 days.

(21) Appl. No.: 16/007,219

(22) Filed: Jun. 13, 2018

(65) Prior Publication Data

US 2018/0289998 A1 Oct. 11, 2018

Related U.S. Application Data

(63) Continuation of application No. PCT/US2018/014992, filed on Jan. 24, 2018.

(60) Provisional application No. 62/449,772, filed on Jan. 24, 2017.

(51) Int. Cl.
*A62C 37/16* (2006.01)
*A62C 37/11* (2006.01)

(52) U.S. Cl.
CPC ..... *A62C 37/16* (2013.01); *A62C 37/11* (2013.01)

(58) Field of Classification Search
CPC ..... A62C 37/10; A62C 37/11; A62C 37/16
See application file for complete search history.

(56) References Cited

U.S. PATENT DOCUMENTS 4,356,478 A 10/1982 Muggli et al.
4,524,344 A 6/1985 Gaia
4,590,999 A 5/1986 Snaper
4,706,758 A * 11/1987 Johnson ..... A62C 37/08 169/19
4,896,728 A * 1/1990 Wolff ..... A62C 37/10 169/26
5,036,923 A 8/1991 Shea, Sr.
5,494,113 A 2/1996 Polan
5,533,576 A 7/1996 Mears
5,622,225 A 4/1997 Sundholm
6,073,700 A 6/2000 Tsuji et al.
6,124,670 A 9/2000 Valone
6,347,669 B1 2/2002 Sundholm
6,427,712 B1 * 8/2002 Ashurst ..... E03B 7/10 137/2
6,491,110 B2 12/2002 Gil
6,863,490 B2 3/2005 Godbersen
6,868,916 B2 3/2005 Petersen
6,896,066 B2 5/2005 Gil
(Continued)

OTHER PUBLICATIONS

International Patent Application PCT/US18/14992 Search Report and Written Opinion dated Apr. 4, 2018. 14 pages.

*Primary Examiner* — Darren W Gorman
(74) *Attorney, Agent, or Firm* — Woodard, Emhardt, Henry, Reeves & Wagner, LLP

(57) ABSTRACT

A sprinkler head for use in a structure for the delivery of a liquid includes a housing, a sleeve, a cap, a spray assembly, a return spring and an SMA spring. The sleeve includes a first portion which is positioned in the housing. The cap is threadedly assembled with the housing. The spray assembly is assembled to a second portion of the sleeve. The return spring is positioned between the cap and the first portion. The SMA spring is positioned between the cap and the spray assembly. The sleeve is movable relative to the housing in order to open a liquid flow path due to activation of the SMA spring resulting from an elevated temperature.

21 Claims, 12 Drawing Sheets

(56) References Cited

U.S. PATENT DOCUMENTS

| | | | | |
|---|---|---|---|---|
| 7,017,673 | B2 * | 3/2006 | Gargani | A62C 31/05 169/19 |
| 8,318,816 | B2 | 11/2012 | Hoffman | |
| 2004/0055763 | A1 | 3/2004 | Petersen | |
| 2004/0089752 | A1 | 5/2004 | Gargani | |
| 2005/0252997 | A1 | 11/2005 | Gluck | |
| 2007/0215720 | A1 | 9/2007 | Koiwa | |
| 2007/0246233 | A1 | 10/2007 | Johnson | |
| 2015/0266141 | A1 | 9/2015 | Johnson | |
| 2016/0061345 | A1 | 3/2016 | Jackson | |

* cited by examiner

SPRINKLER HEAD WITH SMA SPRING

CROSS REFERENCE TO RELATED APPLICATION

This application is a continuation of International Application No. PCT/US2018/014992 filed Jan. 24, 2018, which claims the benefit of U.S. Provisional Patent Application No. 62/449,772 filed Jan. 24, 2017, which are hereby incorporated by reference.

BACKGROUND

Sprinkler heads designed for ceiling and/or wall mounting within a structure are offered in a wide range of sizes, shapes and styles. Internally, the actual mechanisms which result in the release of water (or other liquid) can vary from the sophisticated (and expensive) electronic systems to the less expensive mechanical systems.

Some of the mechanical systems employ the use of a shape-memory alloy (SMA) for fabrication of one or more of the component parts. The design theory associated with the use of this type of SMA material is that it undergoes a change of shape when heated. This type of SMA material may also be referred to as "memory metal". This temperature-based movement which is a characteristic of SMA material can be utilized within a sprinkler head mechanism in order to effect a desired operational or performance result. One use of SMA material in a sprinkler head is as a release component. The typical construction is such that at an elevated temperature the SMA component opens up or expands in some fashion which in turn allows the release of another component. It is the release of this other component which opens the flow path for the liquid. As one example of this type of construction, see the disclosure of U.S. Pat. No. 5,494,113 which issued Feb. 27, 1996.

Another use of SMA material in a sprinkler head is as a catalyst for the fracture of another component. One such example of this use of SMA material is found in US2015/0266141, published Sep. 14, 2015. Described in this published patent application is a temperature-sensitive actuator which includes a frangible bolt and a shape-memory element. The frangible bolt and the shape-memory element are coupled together in such a way that expansion of the shape-memory element may result in breaking of the frangible bolt.

Each of these uses for SMA material for a component part of a sprinkler head has a feature in common. This feature in common is described as being "irreversible". In the first example, once the locating member 58 and control lever 62 fall, there is no automatic mechanism to restore or return these components to their starting positions, prior to the "fall". That particular sprinkler head must be replaced, repaired or reworked in some fashion if it is going to be reused. However, this structure is not automatically reusable as these two components are not moved back to their starting positions automatically. In the second example, once the frangible bolt breaks, that fractured status cannot be reversed. The sprinkler head must be serviced and the frangible bolt must be replaced in order to restore the sprinkler head to its starting or original condition.

In view of the above it would be an improvement for sprinkler head designs which use SMA material if the consequences of an elevated temperature could be automatically reversed and the initial starting condition of the structure restored when the elevated temperature is removed and near standard or normal (ambient) conditions are reestablished. It would also be an improvement for sprinkler head designs using SMA material to have a simpler design with fewer component parts and component parts of less complexity.

The exemplary embodiments of the present invention are directed to providing one or more improvements to the design and functioning of mechanical sprinkler heads.

SUMMARY

According to one embodiment of the present invention, the disclosed sprinkler head includes a main body, an inlet fitting for connection to a supply of liquid and a spray assembly for dispensing liquid which flows through the main body of the sprinkler head. A spreader disc is associated with the spray assembly so that a desired spray pattern is created. The main body of the sprinkler head includes a housing, a cover plate defining an outlet, a movable piston, a SMA spring connected to the movable piston and a return spring. In the starting or ambient condition the piston is positioned over a flow inlet defined by the housing. This positioning of the piston prevents the flow of liquid to the outlet.

The SMA spring has a starting extended length when at or near the ambient room temperature (i.e., at standard conditions). When the SMA spring is "cold" it is stretched so as to be longer than its heated length. As used herein, the term "cold" means at or near the ambient room temperature. The term "heated" means that the SMA spring is raised to an elevated temperature which is sufficient to contract the SMA spring in the first embodiment. In the second embodiment the SMA spring begins in a contracted length and extends in length when heated. Upon reaching an elevated temperature due to a fire, for example, the SMA spring either contracts to a shorter length as in the first embodiment or extends in length as in the second embodiment. In the first embodiment, this length contraction pulls the piston to one side of the housing and takes the piston out of a flow-blocking condition. This allows the flow of liquid from the inlet to the outlet and from there, to be dispensed in a pattern by the spray assembly. When the fire is under control and the temperature within the room or structure returns to something at or near standard conditions, the SMA spring cools and due to its SMA properties, initially remains in its contracted length. However, the movement of the piston has resulted in the compression of the return spring. The return spring then acts on the piston to push it back into its original blocking position over the flow inlet. As the piston is pushed back due to the spring force of the return spring, the SMA spring is extended in length and the entirety of the sprinkler head is returned to its starting (at rest) condition such that the sprinkler head can be reused, without the need for any part replacements or repair intervention.

Nothing in the sprinkler head of the exemplary embodiment has dropped or fallen out of position and nothing has been broken or fractured. The entire sprinkler head is restored to its starting condition without any need to repair, service or replace any portion or component part of the disclosed sprinkler head. The disclosed sprinkler head is reusable and incorporates a small number of component parts for design simplicity and low cost.

The SMA spring when cold has a start martensite deformed length when at or near the ambient room temperature (i.e., standard conditions). The SMA spring when cold is contracted so as to be longer at its heated length. Upon reaching an elevated temperature due to a fire, for example, the SMA spring will expand to a longer length.

This length extension moves the water flow tube (sleeve), out of a flow-blocking condition in the housing. This allows the flow of liquid from the inlet to the outlet and from there to be dispensed in a pattern by the spray assembly. When the fire is under control and the temperature within the room or structure returns to something at or near standard conditions, the SMA spring cools and returns to an at rest or relaxed condition. However, the movement of the flow tube has resulted in the compression of the return spring. The return spring then acts on the flow tube to push it back to its original blocking position over the flow inlet. As the flow tube is pushed back due to the spring force of the return spring, the SMA spring is reduced in length and the entirety of the sprinkler head is returned to its starting (at rest) condition such that the sprinkler head can be reused.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
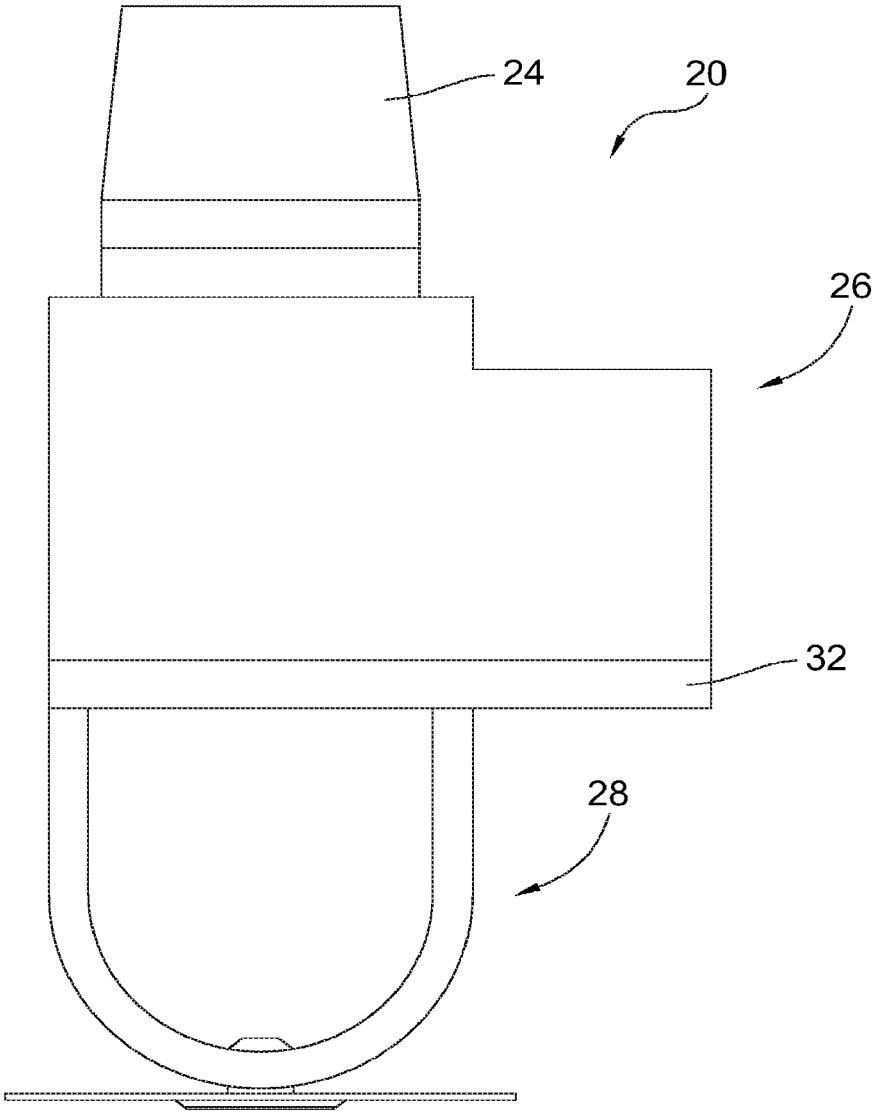
FIG. 1 is a front elevational view of a sprinkler head according to one exemplary embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2A:
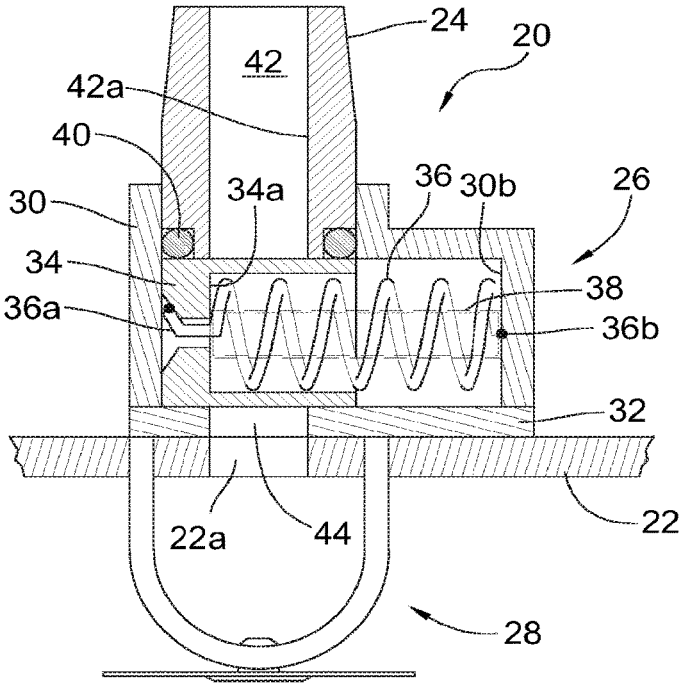
FIG. 2A is a front elevational view of the FIG. 1 sprinkler head, in full section, as mounted to a ceiling in a closed condition.
Figure 2B:
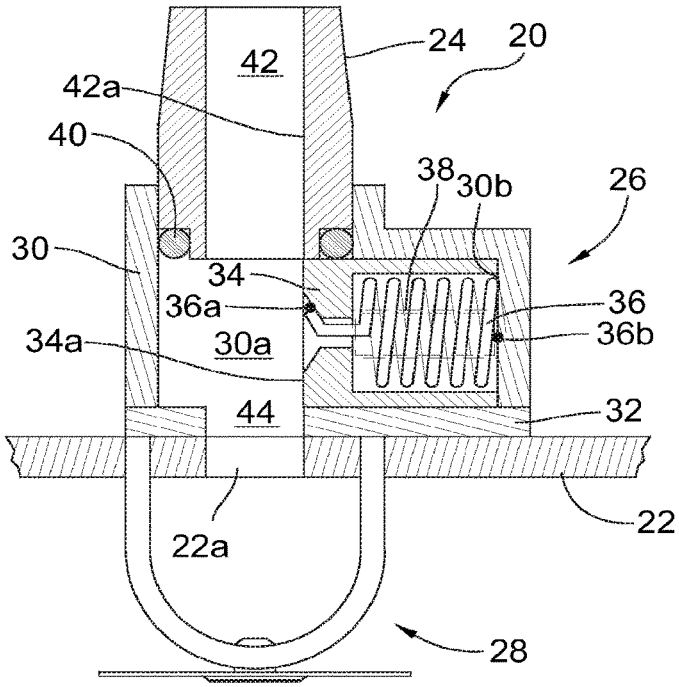
FIG. 2B is a front elevational view of the FIG. 1 sprinkler head, in full section, as mounted to a ceiling in an open condition.
Figure 3:
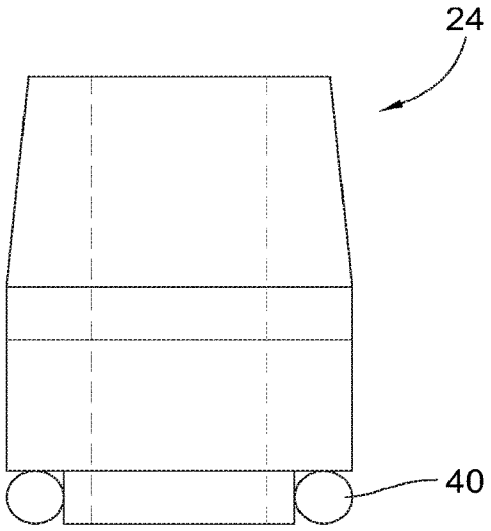
FIG. 3 is a front elevational view of an inlet fitting and O-ring combination which comprises one part of the FIG. 1 sprinkler head.

Referring to FIGS. 1-2B, there is illustrated a sprinkler head 20 according to one exemplary embodiment of the present invention. Sprinkler head 20 is shown in FIGS. 2A and 2B as it could be mounted to a structural ceiling 22, such as in a home, business, store or hotel room, for example. Sprinkler head 20 could also be mounted to a wall, and the desired operation of sprinkler head 20 would not be affected by this alternative mounting arrangement/location. Sprinkler head 20 is in a closed condition in FIG. 2 A and is in an open condition in FIG. 2B. Sprinkler head 20 includes an inlet fitting 24, a main body 26 and a spray assembly 28. The inlet fitting 24 is assembled into the main body 26 and the spray assembly 28 is attached to a cover plate 32 which is fastened to the main body 26. A portion of the spray assembly 28 extends through ceiling 22 which defines a flow opening 22*a*.

The main body 26 includes a housing 30, the cover plate 32, a movable piston 34, a SMA spring 36 and a return spring 38. Also included is an elastomeric O-ring 40 which has a substantially circular lateral cross section and which helps to seal the interface between the inlet fitting 24 and the housing 30 as well as sealing the interface between the housing 30 and the movable piston 34. The housing 30 has an open interior 30*a* which receives the movable piston 34 and the two springs 36, 38. The housing 30 is open along one side to enable the assembly of the interior components. This open side is closed by cover plate 32 by the use of threaded fasteners.

The SMA spring 36 has an extended length with opposing free ends 36*a* and 36*b*. These ends are axially centered for spring alignment. The interior space of spring 36 is substantially cylindrical and receives return spring 38. One end 36*a* of spring 36 is securely affixed to the interior of countersunk hole defined by face 34*a* of piston 34. The other end 36*b* of spring 36 is securely affixed to wall 30*b* of housing 30. The point of attachment for end 36*b* in cooperation with face 34*a* effectively closes off the interior space of spring 36 thereby allowing return spring 38 to be captured and retained within the interior of SMA spring 36 in a telescoping manner.

Figure 4:
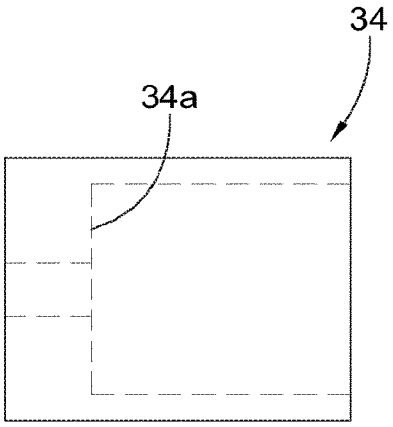
FIG. 4 is a front elevational view of a movable piston which comprises one part of the FIG. 1 sprinkler head.
Figure 5:
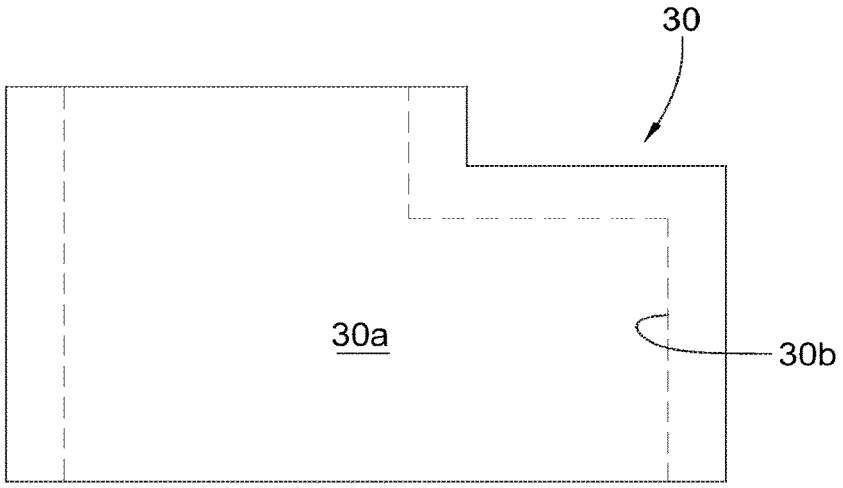
FIG. 5 is a front elevational view of a housing which comprises one part of the FIG. 1 sprinkler head.
Figure 6:
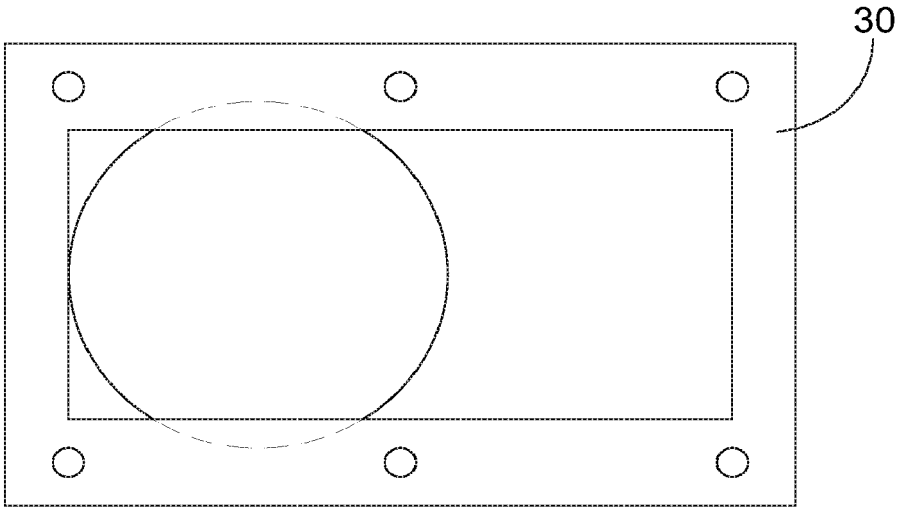
FIG. 6 is a bottom plan view of the FIG. 5 housing.
Figure 7:
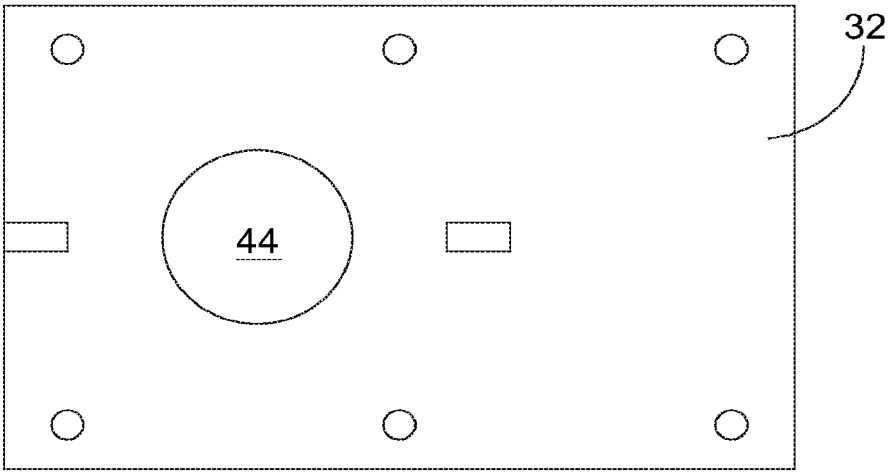
FIG. 7 is a bottom plan view of a cover plate which comprises one part of the FIG. 1 sprinkler head.

With reference to FIG. 4 and continued reference to FIGS. 1-2B, the movable piston 34 (see FIG. 4) is approximately 0.75 inches (1.91 cm) in length with a lateral cross section which is substantially square, measuring approximately 0.62 inches (1.57 cm) on a side. While these dimensions are for reference only, as being selected for this exemplary embodiment, the exact sizing for piston 34 can vary depending on other design considerations, including the design of the two springs 36, 38, the design of the housing 30 and the material selections for these components. There is though an important size relationship between the length of the movable piston 34, the length of the open interior 30*a* of housing 30 and the diameter of O-ring 40. As shown in FIG. 2B, subjecting SMA spring 36 to a requisite elevated temperature causes spring 36 to contract in length and pull piston 34 toward wall 30*b* of housing 30.

It is important for the end face 34 a of piston 34 to completely clear the outer circumferential edge 42*a* of inlet passage 42 for a full fluid flow of the liquid entering housing 30 by way of inlet fitting 24. However, it is also important that face 34*a* not move so far that it clears the body of the O-ring 40. In other words, it is important that the piston 34 remain in contact with the O-ring 40. This "in contact" relationship accomplishes two objectives of this exemplary embodiment. First, it is important to try and maintain a direct flow of liquid from inlet passage 42 to outlet passage 44 for a spray pattern distribution by spray assembly 28. By maintaining a sealed interface between O-ring 40 and piston 34, the likelihood of possibly having secondary flow paths for the entering liquid, flowing around the piston, is reduced. Secondly, and importantly, when the piston 34 is to be moved back to its so termed "starting position" by the action of return spring 38, that particular piston 34 travel does not have to contend with any edge abutment or interference by the piston 34 against the body of O-ring 40. The travel of piston 34 based on the continued contact with O-ring 40 allows the piston 34 to slide over the exposed and facing surface of the O-ring 40, unimpeded, back to the starting position of piston 34 (see FIG. 2A). In this starting position, the inlet passage 42 is sealed closed by the position of piston 34 and the engagement of piston 34 with and compression of O-ring 40.

The sprinkler head 20 of this first exemplary embodiment provides a design and construction which is compact, efficient and reusable. Subjecting the SMA spring 36 to an elevated temperature such as in the range of 175 degrees F. (79.3 degrees C.), due to a fire condition, smoke, etc. causes the SMA spring 36 to contract in length, pulling the piston 34 out of its starting position (see FIG. 2A) which is a liquid flow blocking position. The result of this movement of piston 34 due to the action of the SMA spring 36 is the flow of liquid through housing 30, through the ceiling, and onto spray assembly 28. When the temperature surrounding the sprinkler head is reduced below the SMA "activation" temperature, spring 36 changes from generating a contraction force to an at rest or relaxed condition wherein spring 36 can be easily moved or extended, by light to moderate force. That light to moderate level of force is supplied by the return spring 38 which was compressed and now extends to its starting condition where it holds the piston 34 in position to seal off inlet passage 42. The sprinkler head 20 is now ready to be used again in the event of another elevated temperature condition surrounding sprinkler head 20. As contrasted to prior art constructions, there is nothing in the construction of sprinkler head 20 which needs to fall free, drop, break away, break or fracture and nothing which needs to take a permanent bend or reconfiguration. As such, the disclosed sprinkler head 20 as represented by this first exemplary embodiment, is reusable and cycles between a closed position where liquid flow is blocked and an open position where liquid flow is permitted, dependent entirely on the surrounding temperature.

Figure 8:
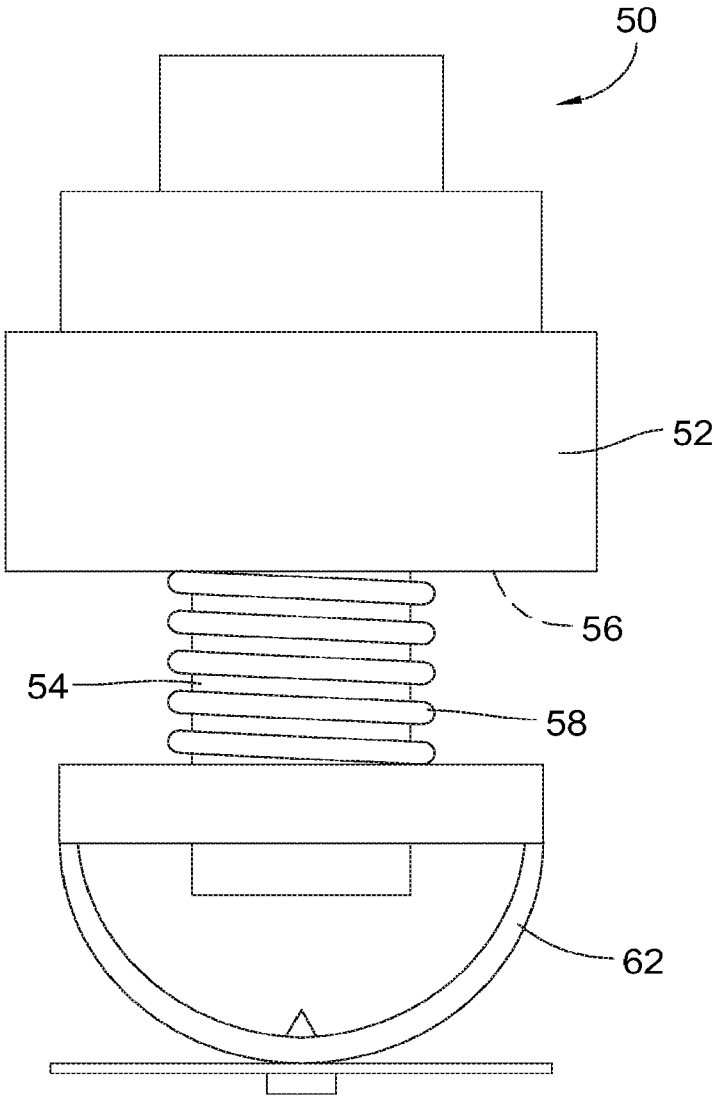
FIG. 8 is a front elevational view of a sprinkler head according to another exemplary embodiment of the present invention.
Figure 9:
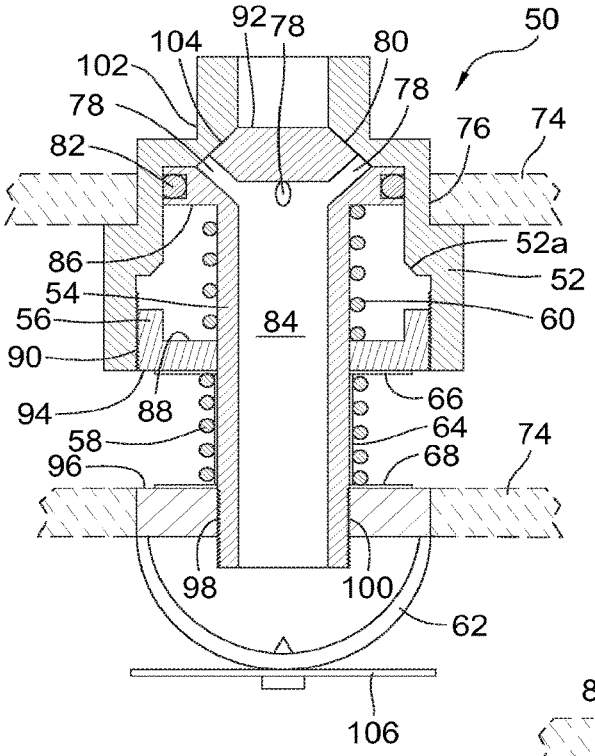
FIG. 9 is a front elevational view of the FIG. 8 sprinkler head, in full section, as mounted to a ceiling panel (two options) in a closed condition.
Figure 10:
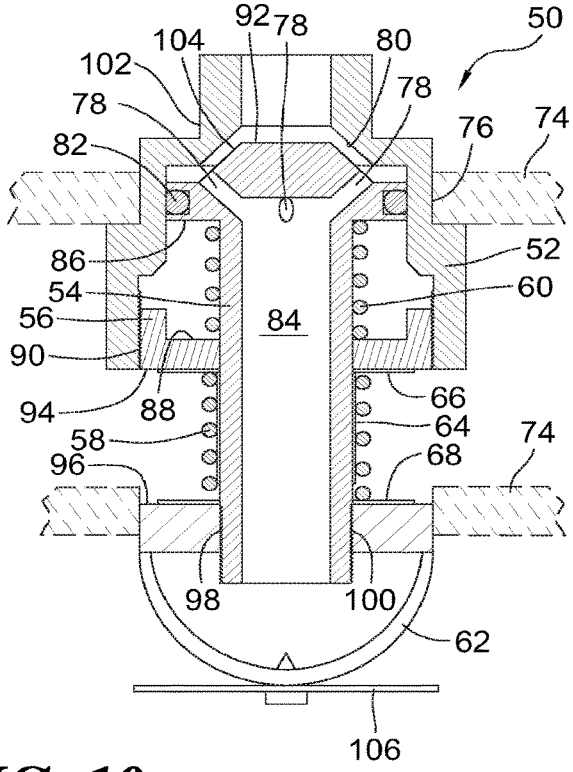
FIG. 10 is a front elevational view of the FIG. 8 sprinkler head, in full section, as mounted to a ceiling panel (two options) in an open condition.
Figure 11:
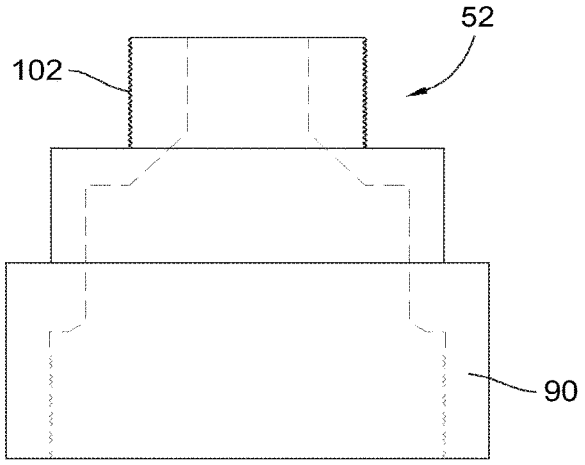
FIG. 11 is a front elevational view of a housing which comprises one component part of the FIG. 8 sprinkler head.
Figure 12:
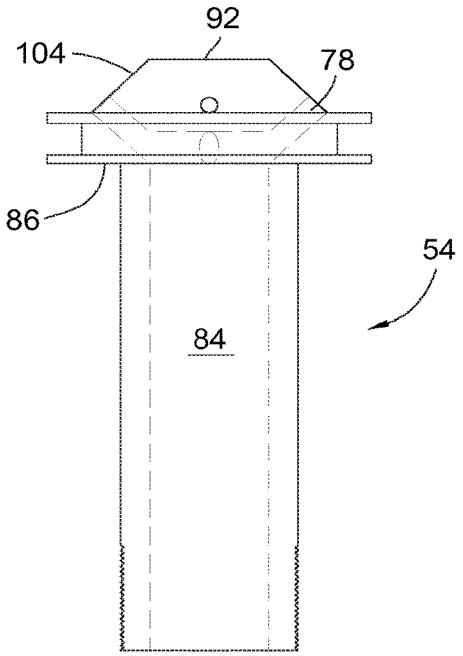
FIG. 12 is a front elevational view of a sleeve which comprises one component part of the FIG. 8 sprinkler head.
Figure 13:
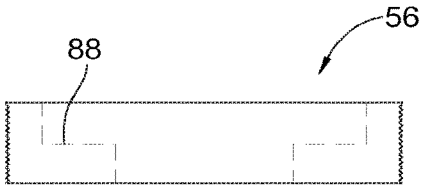
FIG. 13 is a front elevational view of a cap which comprises one component part of the FIG. 8 sprinkler head.
Figure 14:
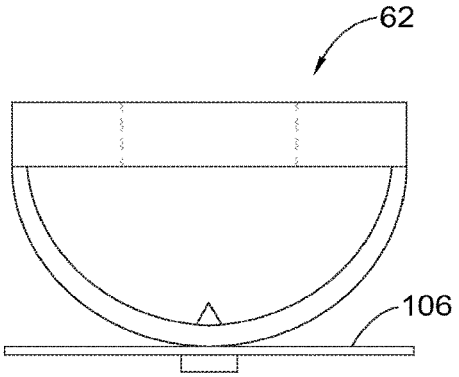
FIG. 14 is a front elevational view of a spray assembly which comprises one portion of the FIG. 8 sprinkler head.
Figure 15:
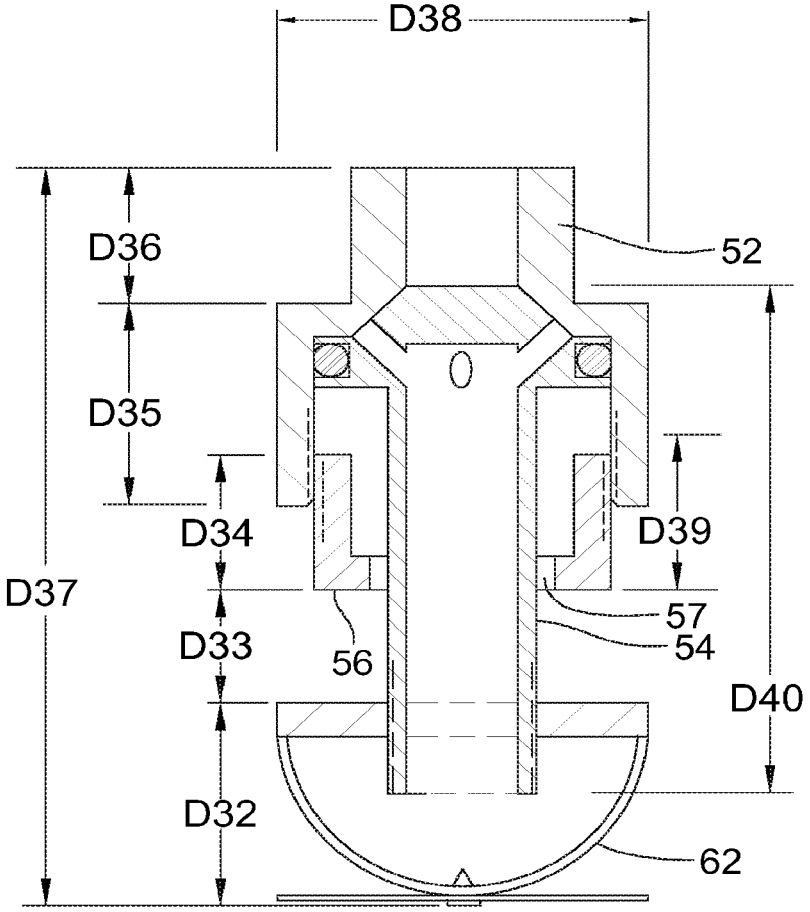
FIG. 15 is a front elevational view, in full section, of the assembly of the component parts of FIGS. 11-14.
Figure 16:
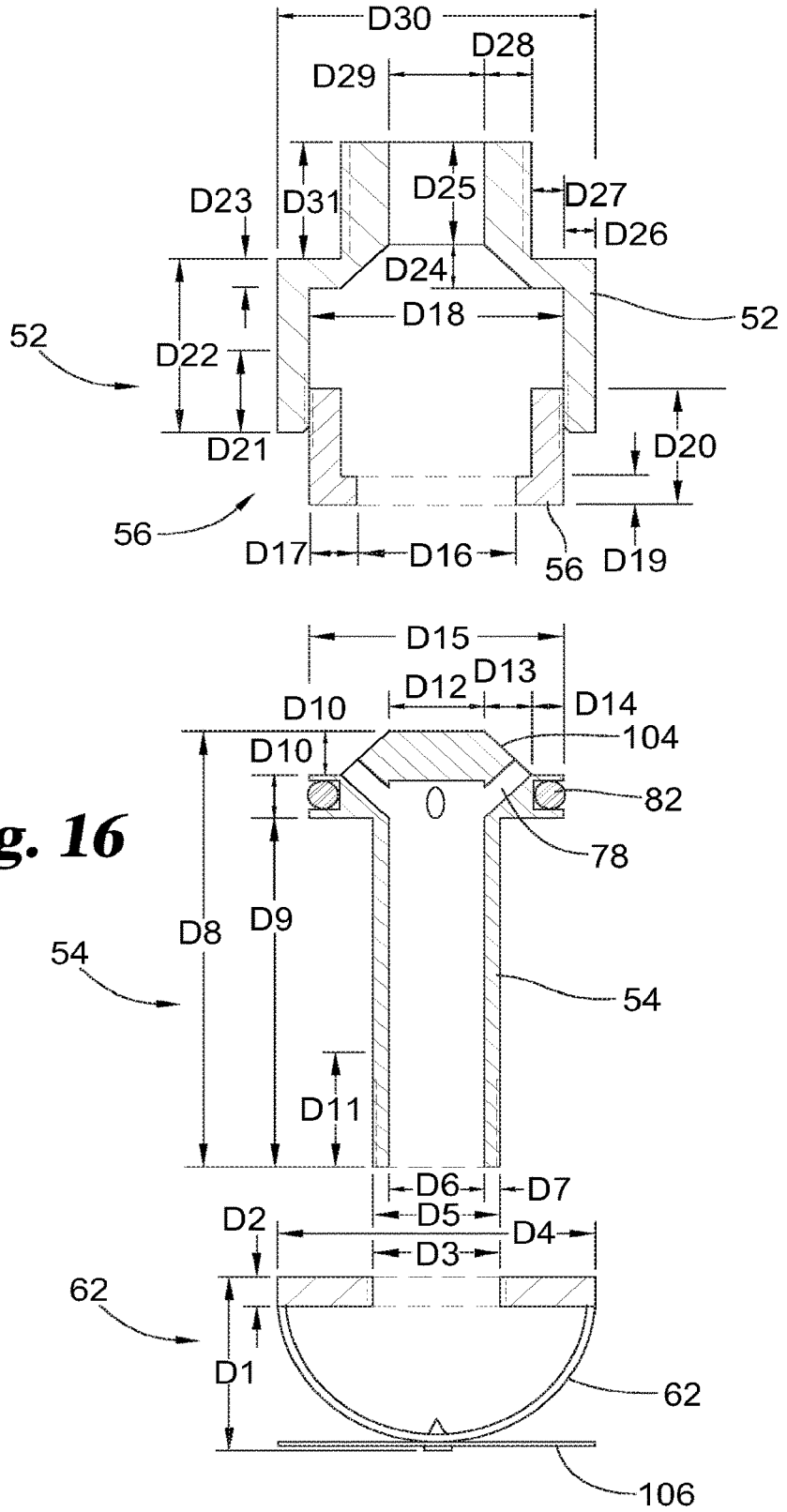
FIG. 16 is an exploded view of the FIG. 15 assembly.

Referring now to FIGS. 8-10, another sprinkler head construction according to a further embodiment of the present invention is illustrated. Sprinkler head 50 includes a housing 52, a water-delivery sleeve 54, a spring-adjust cap 56, an SMA spring 58, a return spring 60 and a spray assembly 62. Also included in the overall construction of sprinkler head 50 is a sleeve of shrink wrap insulation 64 and two insulating washers 66 and 68. The details of housing 52 are illustrated in FIG. 11. The details of sleeve 54 are illustrated in FIG. 12. The details of cap 56 are illustrated in FIG. 13. The details of spray assembly 62 are illustrated in FIG. 14. FIGS. 15 and 16 provide additional illustrations with representative dimensions. A conversion table is provided.

With continued reference to FIGS. 8-10, it will be seen that the assembly of sprinkler head 50 into a ceiling or wall has the spray assembly 62 extending through one side of panel 74 with the remainder of sprinkler head 50 position on the opposite side of panel 74. This is similar to what is illustrated in FIGS. 2A and 2B for sprinkler head 20. Panel 74 which may be a ceiling or wall defines an opening 76 for receiving the sprinkler head 50 and for the flow of liquid, typically water, coming through the housing 52 when the sprinkler head 50 is in and "open" condition, as described herein. This flow through sprinkler head 50 is from one side of panel 74 to the opposite side of panel 74. Two anticipated panel 74 locations relative to sprinkler head 50 are illustrated using broken lines. Either mounting arrangement of sprinkler head 50 relative to the ceiling (or wall) panel 74 is acceptable.

FIG. 8 shows the sprinkler head 50, as assembled, without the presence of either panel 74 location. In FIG. 9 sprinkler head 50 is in a "closed" condition. When sprinkler head 50 is "closed", any flow therethrough of liquid, such as water, is blocked by the position of the component parts. The selected liquid, most likely water, is used to help extinguish a fire when sprinkler head 50 is changed from a "closed" condition to and "open" condition. The illustrated "closed" condition is achieved by blocking or sealing off the designed flow path. This in turn is achieved by the specific positioning of the component parts wherein there is a spring-biased design, the biasing force of which must be overcome for the sprinkler head 50 to move to its "open" condition for the flow of liquid to pass therethrough. In FIG. 10 sprinkler head 50 is in an "open" condition. The change of state of SMA spring 58 due to experiencing an elevated temperature has resulted in overcoming the spring-biased force, thereby opening the sprinkler head 50 for the flow of liquid therethrough.

With continued reference to FIG. 9, the closed or at least at rest condition of sprinkler head 50 is illustrated. The sleeve 54 is fully seated into housing 52 such that the flow openings 78 are closed off by surface 80. The O-ring 82 provides a sealed interface so as to prevent any by-pass flow of liquid from occurring. When the sleeve 54 is moved off of surface 80 of the housing 52, see FIG. 10, the incoming liquid which is typically water, is intended to flow in its entirety through the hollow interior 84 of sleeve 54, rather than having any leakage or by-pass flow around the exterior surface of sleeve 54. A chamfer 52*a* on the inner annular corner prevents O-ring damage during assembly.

Sleeve 54 is spring biased against valve seat surface 80 of housing 52 due principally to the biasing force of return spring 60 and the positioning or threaded adjustment of cap 56 which provides the other abutment surface for spring 60. As is illustrated, spring 60 is captured between face 86 of sleeve 54 and seat 88 of cap 56. The threaded assembly of cap 56 into the internally-threaded end 90 of housing 52 allows the level of biasing force for spring 60 to be adjusted and varied. It is to be understood that cap 56 can be assembled to or into housing 52 in a variety of ways so long as the adjustability aspect for spring 60 is retained.

There are two important considerations in setting the spring biasing force of spring 60 which pushes sleeve 54 into engagement with seat surface 80 of housing 52. One consideration is to determine the minimum force required for a sealed interface across the entire abutment surface. The sprinkler system is essentially always "ON" in terms of having a flow of water ready to be delivered. As such, there is a system water pressure always present and always seen by the upper end 92 of sleeve 54. This system pressure is acting to push the sleeve 54 off of surface 80. The spring biasing force which spring 60 applies must exceed the water pressure. Slight variations in system pressure can be addressed by the use of cap 56 and its threaded adjustability as assembled to or within housing 52.

The second consideration for spring 60 is to understand the force level which can be achieved by the internal extension of SMA spring 58. In the embodiment of FIGS. 8-10, the SMA spring is constructed and arranged to extend in length when heated. As the SMA spring 58 extends in length it produces a spring force which is sufficient to pull sleeve 54 off of surface 80 so the water is able to flow through opening 78 into hollow interior 84 and from there to the spray assembly 62.

Since there is an existing water pressure acting on sleeve 54, the only biasing force to be overcome is the excess force of spring 60 over the water pressure as applied over the exposed area of the sleeve. The excess force due to spring 60 which establishes a sealed interface between sleeve 54 and housing 52 is what needs to be overcome by the force from the activation of SMA spring 58. As noted, as the SMA spring 58 elongates, one end will push against cap 56 while the other end pushes against a portion of the spray assembly 62. As noted, the spray assembly is threadedly attached to one end of sleeve 54 and this combination is movable relative to the housing. As such, the activation of SMA spring 58 which results in its elongation essentially pulls the sleeve 54 off of or away from surface 80 so as to provide a sufficient clearance for the flow of liquid (water) through the flow openings 78 and ultimately to the spray assembly 62. The spray assembly 62 includes a structural frame, portions of which may be shaped or contoured so as to preliminarily help disperse the flowing liquid into a desired spray pattern for helping to extinguish the fire.

Fire sprinkler heads are guaranteed for 175 pounds (79.3 kg) of water pressure. Surface 92 is approximately 0.375 inches (0.93 cm) in diameter yielding an area of approximately 0.1104 square inches (0.712 square cm). This in turn results in having approximately 19.32 pounds (8.76 kg) of pressure. In addition there can be as much as 20 pounds (9.07 kg) of SMA spring back pressure as the temperature increases. It is felt that 20 pounds (9.07 kg) would be enough of a safety factor resulting in 39.32 pounds (17.84 kg) of pressure in order to keep the valve closed. When the water starts to flow this will be reduced or eliminated. When the flow tube is pulled up by approximately 0.156 inches (3.96 mm) by the SMA spring, the load on spring 60 is approximately 38.07 pounds (17.27 kg) plus the 31.73 pounds (14.39 kg) totaling approximately 69.80 pounds (31.66.kg). The spring rate or constant is approximately 12.69 pounds (5.76 kg) per 0.0625 inches (1.59 cm) of compression.

When the SMA spring 58 senses an elevated temperature, in this case due to fire, which exceeds the SMA activation temperature, there is a change of state of the SMA spring 58 and it begins to extend or elongate in length. This elongation creates a pushing force at the opposite ends of spring 58. These forces try to increase the distance of separation between the outer face 94 of cap 56 and plate 96 of spray assembly 62. The use of two insulating washers 66 and 68 means that the opposite ends of the SMA spring 58 actually contact their respective insulating washers. However, the relative movement which is created due to elongation of the SMA spring 58 is between outer face 94 and plate 96. Housing 52 is fixed in position relative to the mounting structure, such as a ceiling or wall as represented by panel 74, and sleeve 54 has an axial sliding fit within housing 52 and within cap 56. The threaded end 98 of sleeve 54 is threaded into an internally-threaded opening 100 and plate 96. This threaded engagement secures the sleeve to or with the spray assembly 62 such that there is no relative movement between the two except by rotation and threaded travel, used herein for dimensional adjustments.

As the SMA spring 58 elongates due to the presence of an elevated temperature (a temperature which is at or above the SMA activation temperature), the extension force acting on plate 96 moves sleeve 54 off of surface 80. The separation between sleeve 54 and surface 80 creates a flow path for the liquid, typically water, entering through the externally-threaded end 102 of housing 52. The entering liquid flows across face 104 and is directed into the four equally-spaced flow openings 78. From the four flow openings 78, the liquid travels through the hollow interior 84 and onto the diverter 106 of the spray assembly 62.

The sleeve of shrink wrap insulation 64 is positioned around the outer surface of the sleeve 54 between the sleeve 54 and the SMA spring 58. The insulation 64 in combination with insulating washers 66 and 68 are all constructed and arranged to help insulate the SMA spring 58 from seeing the lower temperature of the liquid flowing through the sprinkler head 50. The disclosed embodiments operate on the principle of opening a liquid flow path once the SMA spring is exposed to its activation temperature. The flow of liquid is intended to continue until that activation temperature is removed, presumably by putting out the fire or at least getting the fire under control such that the ambient temperature is reduced. If the flow of liquid would affect the ambient temperature which the SMA spring 58 sees, there could be a false positive in the sense of the SMA spring returning to an at rest or relaxed condition where that spring could be easily moved or contracted by light to moderate force. It is important that the SMA spring 58 not be moved to this at rest or relaxed condition prematurely.

When the fire is either put out or under control whereby the ambient temperature is reduced to a level which is below the SMA spring 58 activation temperature, the SMA spring 58 changes from generating a spring force to an at rest or relaxed condition wherein the SMA spring 58 can be easily moved or contracted, by light to moderate force. That light to moderate force is supplied by return spring 60 which was compressed and now extends back to its starting condition where it holds sleeve 54 in sealed abutment against surface 80, closing off the flow opening 78.

As described for the first embodiment, as soon as the elevated activation temperature, presumably due to fire condition, is reduced the sprinkler head 50 returns to a closed condition. This means that the spray of liquid from sprinkler head 50 stops as soon as the fire condition is either eliminated or at least is under control such that continued spraying of liquid is no longer needed. By stopping the continued spraying of liquid once the fire condition is eliminated or otherwise under control, the risk of having greater damage due to a continuing spray of liquid is lessened or removed.

Referring now to FIGS. 11-14, four of the main structural components of sprinkler head 50 are illustrated. Not included as a part of FIGS. 11-14 are springs 58 and 60, the insulating washers 66 and 68, and O-ring 82. Included as a part of FIGS. 11-14 are the housing 52 (FIG. 11), the sleeve 54 (FIG. 12), the cap 56 (FIG. 13), and the spray assembly 62 (FIG. 14). These four components are illustrated as an assembly, in full cross-section, in FIG. 15. The FIG. 15 assembly is illustrated as a partially exploded view in FIG. 16. The FIG. 16 partially exploded view does not include the SMA spring 58, simply for drawing clarity in terms of having less complexity. In FIGS. 15 and 16 dimensional references are provided as D1-D40 and Table I provides corresponding exemplary dimensional values in both English and metric units for each of these dimensions. These dimensions are provided to convey a general understanding of the relative size of the components of one exemplary embodiment of sprinkler head 50, according to the present invention. The dimensions of Table I are not intended to be limiting as dimensional variations are possible within the overall teachings of the present invention. Additionally, face 104 has an approximate 45 degree angle and the approximate diameter of each flow opening 78 is 0.093 inches (2.38 mm).

TABLE 1

| Exemplary Dimension | Inches (English) | Millimeters (Metric) |
|---|---|---|
| D1 | .750 | 19.05 |
| D2 | .125 | 3.17 |
| D3 | .500 | 12.70 |
| D4 | 1.25 | 31.75 |
| D5 | .500 | 12.70 |
| D6 | .375 | 9.52 |
| D7 | .125 | 3.17 |
| D8 | 1.87 | 47.50 |
| D9 | 1.500 | 38.10 |
| D10 | .187 | 4.75 |
| D11 | .375 | 9.52 |
| D12 | .375 | 9.52 |
| D13 | .187 | 4.75 |
| D14 | .125 | 3.17 |
| D15 | 1.00 | 25.40 |
| D16 | .625 | 15.87 |
| D17 | .187 | 4.75 |
| D18 | 1.000 | 25.4 |
| D19 | .125 | 3.17 |
| D20 | .500 | 12.70 |
| D21 | .312 | .792 |
| D22 | .750 | 19.05 |
| D23 | .125 | 3.17 |
| D24 | .187 | 4.75 |
| D25 | .437 | 11.10 |
| D26 | .125 | 3.17 |
| D27 | .125 | 3.17 |
| D28 | .187 | 4.75 |
| D29 | .375 | 9.52 |
| D30 | 1.250 | 31.75 |
| D31 | .500 | 12.70 |
| D32 | .750 | 19.05 |
| D33 | .500 | 12.70 |
| D34 | .500 | 12.70 |
| D35 | .750 | 19.05 |
| D36 | .500 | 12.70 |
| D37 | 2.750 | 69.85 |
| D38 | 1.250 | 31.75 |
| D39 | .562 | 14.27 |
| D40 | 1.875 | 47.62 |

With continued reference to FIG. 15, there are other design modifications which may be an option for the final construction of a suitable sprinkler head according to the present invention. One optional design modification relates to the relationship between cap 56 and sleeve 54. While these two components are essentially in near contact with each other (i.e. a sliding fit) as is shown in FIGS. 9 and 10, a larger clearance space can optionally be provided as illustrated in FIG. 15 for adding a layer (or sleeve) of insulation between cap 56 and sleeve 54. This additional clearance space 57 is annular in the exemplary embodiment and is of a uniform radial width.

Another optional design modification is to change the frustoconical form of surface 104 from a 45 degree angle below horizontal to a larger angle below horizontal. Extending surface 104 to its apex defines a 90 degree included angle at the apex. The modification of changing the 45 degree angle brings surface 104 radially inwardly which in turn causes a decrease in the angular size of the included angle at the apex. Making this modification creates a larger water path as soon as the valve, defined by sleeve 54 in contact with housing 52, opens and the incoming water or other liquid then acts on sleeve 54, specifically surface 104, to help facilitate opening of the valve.

Figure 15B:
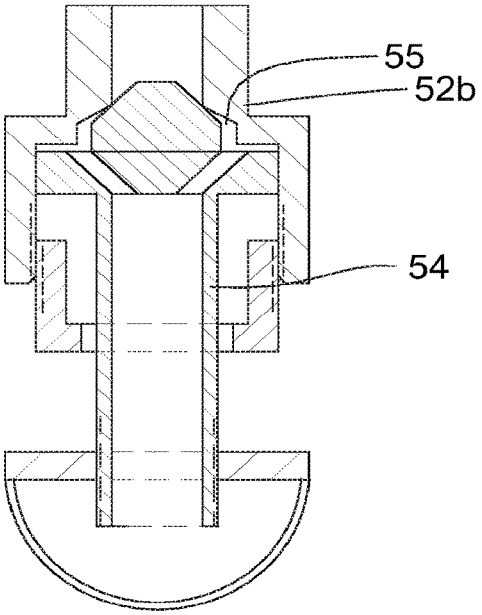
FIG. 15B is a diagrammatic illustration of an alternative valve seat construction to the frustoconical valve seat of FIG. 15.
Figure 15A:
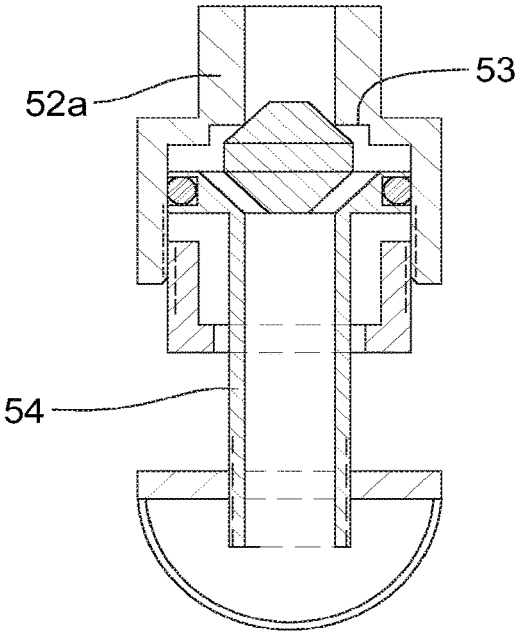
FIG. 15A is a diagrammatic illustration of an alternative valve seat construction to the frustoconical valve seat of FIG. 15.

This particular option design modification is expanded further by the design alternatives of FIGS. 15A and 15B. In FIG. 15A, the frustoconical form of surface 80 is changed into a counterbore 53 design. The inner angular corner of the counterbore 53 of housing 52*a* defines the valve seat for sleeve 54. As described for the optional design modification of FIG. 15 where the frustoconical form is changed, the FIG. 15A design modification enables the incoming liquid to apply a liquid pressure of the surface of the valve member (i.e. sleeve 54) to help facilitate opening up of the valve.

The alternative construction of FIG. 15B adds a frustoconical form 55 to the straight counterbore 53. Housing 52*b*, like housing 52*a*, is otherwise the same as housing 52, except for the respective changes to frustoconical surface 80.

Figure 17:
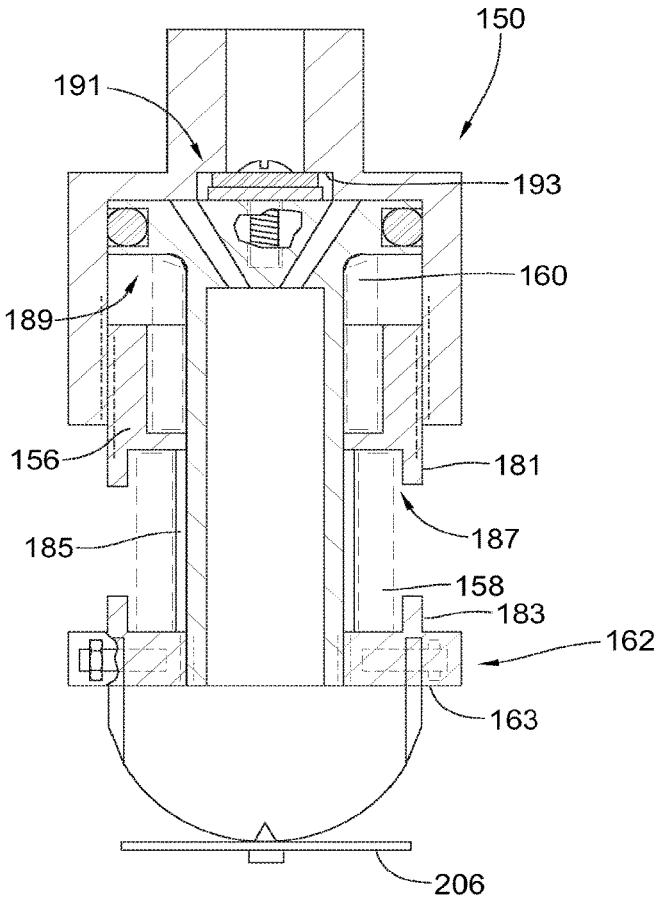
FIG. 17 is a front elevational view, in full section, of another exemplary embodiment of the present invention.
Figure 18:
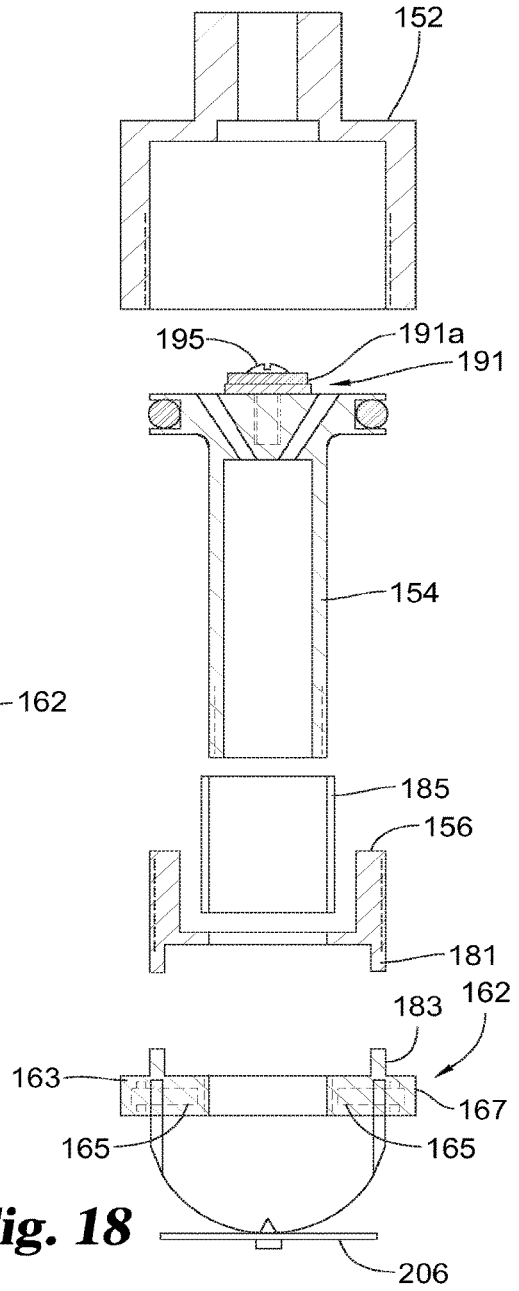
FIG. 18 is an exploded view of the FIG. 17 embodiment.
Figure 19:
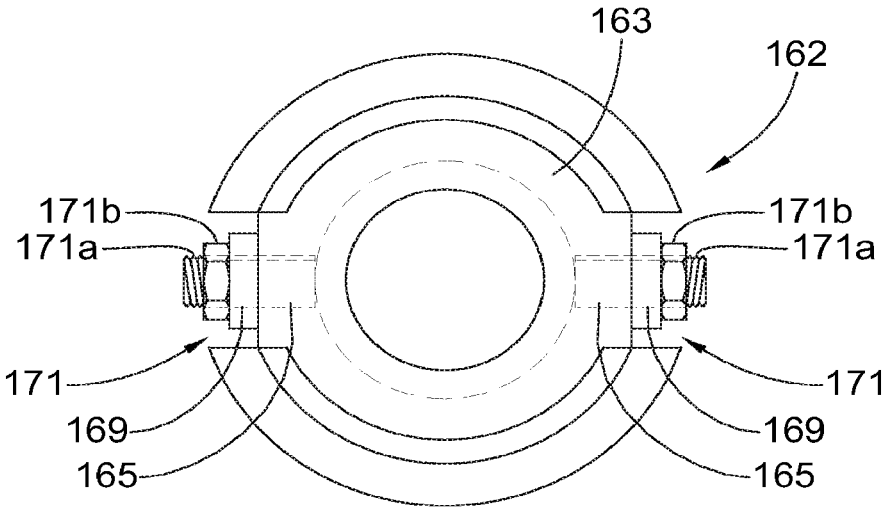
FIG. 19 is a top plan view of the spray assembly which comprises one portion of the FIG. 17 embodiment.

Referring now to FIGS. 17, 18 and 19 another exemplary embodiment of the present invention is illustrated. Sprinkler head 150 is similar in many respects to sprinkler head 50 in terms of the overall construction and the functioning of the component parts including the two springs 158 and 160. The reference numbers of FIGS. 17-19 are similar to FIGS. 8-16 for similar or like components with the addition of 100 to the prior reference number. For example, sprinkler head 50 is now numbered as sprinkler head 150 in the exemplary embodiment of FIGS. 17-19. The overall use and operation of sprinkler head 150 generally follows what has been described for sprinkler head 50. The descriptions and explanations of sprinkler head 50 should be used for sprinkler head 150, except as noted below regarding new features, dimensions and force levels. Four of the primary structural components of sprinkler head 150 are housing 152, sleeve 154, cap 156 and spray assembly 162.

The FIG. 17 illustration uses a broken line outline to denote SMA spring 158 and a similar broken line outline to denote spring 160. The decision to use a broken line outline is simply for drawing clarity in terms of not needing to illustrate each and every coil of these two springs. As illustrated and as described herein, SMA spring 158 is captured within the generally cylindrical pocket 187 and spring 160 is captured within the generally cylindrical pocket 189.

One difference between sprinkler heads 50 and 150 is found in the construction and arrangement of spray assembly 162 as compared to the construction and arrangement of spray assembly 62. In the embodiment of FIGS. 8-16 the spray assembly 62 is threadedly assembled onto the end of sleeve 54. This particular style of threaded connection results in a fixed position and a fixed orientation for spray assembly 62, in particular a fixed position and a fixed orientation for diverter 106. One change introduced by the construction of spray assembly 162 is to add a threaded collar 163 with opposed pivot holes 165. The threaded collar 163 is internally threaded so as to threadedly assembled onto sleeve 154. The skirt 167 of spray assembly 162 includes opposed pivot holes 169 which are sized, shaped and arranged to align with pivot holes 165. Fasteners 171 (see FIG. 17) are used to assemble the lower skirt 167 and thus spray assembly 162 to threaded collar 163. In the exemplary embodiment of FIGS. 17-19, each fastener 171 includes a set screw 171*a* and a cooperating nut 171*b*. Spray assembly 162 can be considered as including the threaded collar 163 due to their "assembly" by way of fasteners 171 are alternatively these two components, spray assembly 162 and threaded collar 163, can be treated as separate component parts.

What is provided by the combination of spray assembly 162 and threaded collar 163 using the threaded fasteners 171 is the ability to rotate or tilt the spreader/diverter 206. As is illustrated and described, the threaded fasteners 171 provide a pivot axis and an ability to rotate or tilt the spreader/diverter 206 by first loosening the fasteners 171. Once fasteners 171 are loosened the user is able to make the desired adjustment in terms of the tilt or orientation for spreader/diverter 206. Once the desired adjustment is made the fasteners 171 are then tightened. This disclosed construction allows each sprinkler head 150 to be customized in terms of the desired spray pattern direction for each installation site or location. Once the desired spray pattern direction is manually selected for each installation, the fasteners 171 are tightened by way of the engagement of each nut 171*b* with its corresponding screw 171*a*.

Another difference between sprinkler heads 50 and 150 is the addition of two generally cylindrical walls 181 and 183 as one option for the capture of SMA spring 158. Wall 181 is added as an integral part or portion of cap 156 and extends in the direction of wall 183. Wall 183 is added as an integral part or portion of spray assembly 162 and extends in the direction of wall 181. Walls 181 and 183 are approximately 0.062 inches (1.57 mm) in thickness with an inside diameter of approximately 0.875 inches (22.23 mm).

With continued reference to FIG. 17, it will be seen that insulation sleeve 185 fits around sleeve 154 radially inwardly of walls 181 and 183. This assembly of component parts defines a generally cylindrical pocket 187 for receipt of the SMA spring 158. The generally cylindrical pocket 189 receives spring 160. The coil construction of the SMA spring 158 defines a hollow interior and an outer surface, both of which are annular. The hollow interior fits around and receives the insulation sleeve 185. The outer surface of the SMA spring 158 is captured and retained in position by walls 181 and 183. The SMA spring 158 as a coil spring has opposite free ends and each free and is captured by a corresponding one of walls 181 and 183.

It is important to the operation of sprinkler heads 50 and 150 that the SMA Springs 58 and 158, respectively, move in a predominantly axial direction rather than in a predominantly radial manner or radial direction. Walls 181 and 183 are used to help capture and retain the SMA spring 158 and to enhance the likelihood that the SMA spring 158 will move, in response to a change in temperature, in a predominantly axial direction which is generally parallel with the longitudinal axis of sleeve 154. As explained, walls 181 and 183 provide one option for assisting in the control of SMA spring 158 such that expansion and contraction due to temperature change occurs in the desired direction. Whatever design option might be selected, whether using walls 181 and 183 or using some other construction, the objective is the same. This objective is to control and manage the expansion and contraction of the SMA spring 158 to achieve the desired direction and manner of motion.

The opening and closing of the liquid inlet valve, regardless of the particular embodiment, involves movement of the sleeve 54 relative to housing 52 including the design variations for these two component parts. The movement of sleeve 54 is preferably axial or longitudinal and by not deviating off of an axial travel path, the valve opens and closes more efficiently.

In order to facilitate the efficient opening and closing of the liquid inlet valve, it is important for the two springs 58 and 60 as well as the alternate embodiment involving springs 158 and 160, to move axially as they extend and contract. Any movement of either spring off of a true axial path, such as any deviation laterally or radially, is believed to be less efficient in the overall operation of the particular embodiment.

While walls 181 and 183 offer one design option to facilitate the axial movement of the SMA spring 58, 158, other design options are contemplated such as means to secure the spring ends and the use of other components for capture and/or spring guidance. In addition to focusing on accurate and true axial movement of the springs, as a means for more efficient opening and closing of the liquid inlet valve, any movement off of an axial path such as any deviation laterally or radially may decrease the axial force vectors and could alter the overall design in terms of the selected spring sizes and spring constants.

Another difference between the exemplary embodiments of sprinkler head 50 and sprinkler head 150 is the addition of a valve 191 to the water inlet location of sleeve 154. The valve seat 193 is formed as part of housing 152 as shown in the assembly illustration of FIG. 17. The valve member 191*a* is an elastomeric component which is secured in position by threaded fastener 195.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A sprinkler head for use in a structure for the delivery of a liquid, said sprinkler head comprising:

a housing defining an inlet passage;

a sleeve with a first portion positioned in said housing, wherein said first portion has a valve face that seals said inlet passage to close a liquid flow path;

a cap assembled to said housing;

a spray assembly assembled to a second portion of said sleeve;

a return spring positioned between said cap and said first portion, wherein said return spring applies a force between said cap and said first portion to seal said inlet passage to close the liquid flow path;

an SMA spring positioned between said cap and said spray assembly; and wherein said sleeve is movable relative to said housing to open said liquid flow path due to activation of said SMA spring, wherein said SMA spring applies a force to said sleeve to move said sleeve to open said inlet passage to open said liquid flow path when said SMA spring is activated.

2. The sprinkler head of claim 1 wherein said cap is threadedly engaged with said housing for adjustably setting a biasing force of said return spring.

3. The sprinkler head of claim 1 which further includes insulation positioned between said sleeve and said SMA spring.

4. The sprinkler head of claim 1 which further includes an O-ring for sealing between said first portion and said housing.

5. The sprinkler head of claim 4 wherein said O-ring is constructed and arranged for sealing contact with said housing throughout any travel of said sleeve which is due to said SMA spring.

6. A sprinkler head for use in a structure for managing a flow of liquid into said structure, said sprinkler head comprising:

a first member defining an inlet for a flow of liquid;

a second member received within said first member, at least one of said first member and said second member being moveable relative to the other member between an inlet-closed position and an inlet-open position;

a spray assembly;

a SMA spring which is constructed and arranged to bias the relative movement between said first member and said second member to the inlet-open position; and a second spring which is constructed and arranged to bias the relative movement between said first member and said second member to the inlet-closed position.

7. The sprinkler head of claim 6 wherein said first member includes the threaded assembly of a cap into a housing.

8. The sprinkler head of claim 7 wherein the position of said cap within said housing is adjustable.

9. The sprinkler head of claim 8 wherein the adjustable position of said cap within said housing adjusts the spring force of said second spring and/or of said SMA spring.

10. The sprinkler head of claim 6 wherein said spray assembly includes an adjustable portion for enabling a variable distribution pattern for said liquid.

11. The sprinkler head of claim 6 wherein said spray assembly includes a first spring wall and said first member includes a second spring wall, said first and second spring walls cooperatively defining a spring-capture pocket.

12. The sprinkler head of claim 11 wherein said SMA spring is received within said spring-capture pocket.

13. A sprinkler head for use in a structure for the delivery of a liquid, said sprinkler head comprising:

a housing defining a liquid inlet;

a sleeve received within said housing and being constructed and arranged to be movable relative to said housing;

a spray assembly constructed and arranged for receiving liquid from said liquid inlet;

a first spring fabricated of a shape memory alloy;

a second spring received within said housing and positioned between said liquid inlet and said first spring; and wherein said first spring and said second spring each receive a portion of said sleeve.

14. The sprinkler head of claim 13 which further includes a cap received by said housing, wherein said first spring extends between said cap and said spray assembly.

15. The sprinkler head of claim 14 wherein said second spring extends between a portion of said sleeve and said cap.

16. The sprinkler head of claim 13 wherein said housing defines a valve seat surface and said sleeve includes a cooperating valve face, wherein movement of said cooperating valve face away from said valve seat surface opens a flow path for entering liquid.

17. The sprinkler head of claim 16 wherein said second spring is constructed and arranged to apply a closing force on said sleeve to move said cooperating valve face toward said valve seat surface.

18. A sprinkler head for use in a structure for the delivery of a liquid, said sprinkler head comprising:

a housing defining a liquid inlet;

a sleeve received within said housing and being constructed and arranged to be movable relative to said housing;

a spray assembly constructed and arranged for receiving liquid from said liquid inlet;

a first spring fabricated of a shape memory alloy;

a second spring received within said housing and positioned between said liquid inlet and said first spring;

wherein said housing defines a valve seat surface and said sleeve includes a cooperating valve face, wherein movement of said cooperating valve face away from said valve seat surface opens a flow path for entering liquid; and wherein said second spring is constructed and arranged to apply a closing force on said sleeve to move said cooperating valve face toward said valve seat surface.

19. The sprinkler head of claim 18 wherein said first spring and said second spring each receive a portion of said sleeve.

20. The sprinkler head of claim 18 which further includes a cap received by said housing, wherein said first spring extends between said cap and said spray assembly.

21. The sprinkler head of claim 20 wherein said second spring extends between a portion of said sleeve and said cap.

* * * * *